United States Patent [19]

White

[11] Patent Number: 4,598,967

[45] Date of Patent: Jul. 8, 1986

[54] QUICK CHANGE COUPLING

[75] Inventor: Billy W. White, Duncan, Okla.

[73] Assignee: Halliburton Company, Duncan, Okla.

[21] Appl. No.: 624,877

[22] Filed: Jun. 26, 1984

[51] Int. Cl.[4] ..... H01R 13/62

[52] U.S. Cl. ..... 339/89 R; 339/94 R; 339/186 R

[58] Field of Search ..... 339/89, 90, 42, 94, 339/186, 42, 117 R, 117 P, 88 R, 89 R, 89 M

[56] References Cited

U.S. PATENT DOCUMENTS

| | | | |
|---|---|---|---|
| 2,605,315 | 7/1952 | Hargett | 339/94 M |
| 2,700,140 | 1/1955 | Phillips | 339/89 M |
| 3,176,259 | 3/1965 | Macnamara | 339/94 M |
| 3,719,918 | 3/1973 | Kerr | 339/90 R |
| 4,042,291 | 8/1977 | Moriyama | 339/89 M |
| 4,094,567 | 6/1978 | Karcher et al. | 339/42 |
| 4,304,456 | 12/1981 | Takaki et al. | 339/89 M |
| 4,445,743 | 5/1984 | Bakker | 339/89 M |

*Primary Examiner*—Gil Weidenfeld
*Assistant Examiner*—David L. Pirlot
*Attorney, Agent, or Firm*—Joseph A. Walkowski

[57] ABSTRACT

The present invention comprises a quick change coupling for hostile environment including means to assure alignment of electrical connectors carried by mating male and female components of said coupling, seal means between said components, and biasing means to assure the continued, non-damaging engagement of said electrical connectors.

9 Claims, 10 Drawing Figures

QUICK CHANGE COUPLING

BACKGROUND OF THE INVENTION

This invention relates to electrical connectors in general and more specifically to a quick change electrical coupling for use in a hostile environment such as may be encountered by logging instruments in an oil or gas well bore.

It is necessary, when connecting electrical instruments such as logging tools to be disposed in a well bore under high pressure and/or temperature and in the presence of corrosive fluids, to provide a leak-proof coupling which also ensures proper alignment of the pin and socket type connectors most often employed in such tools. However, such a coupling must also be relatively easy to couple and uncouple, and to withstand the rough treatment it may encounter on the floor of the drilling rig. Ideally, such a coupling is rugged, simple in design and requires a minimum of parts to assemble.

One connector for use in hostile environments is disclosed in U.S. Pat. No. 3,719,918, issued to Wayne L. Kerr on Mar. 6, 1973. This connector uses a radial protrusion on one portion of a coupling to mate with a radial recess on the interior of its cooperating portion. A seal against sea water or other moisture entry is provided by an O-ring, and the two portions of the connector are locked together with a pin-in-slot bayonet type coupling. While suitable, perhaps, for use on a rig floor or on a ship where the connector may be subjected to salt spray and high pressure water in the form of waves, the Kerr connector is totally unsuitable for undersea or well bore environments where pressures may be in the thousands of pounds per square inch.

SUMMARY OF THE INVENTION

The present invention comprises a quick change coupling for hostile environments, the coupling comprising a female coupling component including a coupling body and a sleeve extending coaxially therefrom, and a male coupling component which is inserted into the sleeve. Seal means effect a pressure-tight seal between the male coupling component and the sleeve. The male coupling component carries a socket body which is aligned by a key with a pin body in the female coupling component, the key preventing relative rotation of the socket and pin bodies as the male coupling component is threaded into the sleeve. When the pins are made up with their cooperating sockets, the pin body is resiliently biased against the socket body to assure proper connecting pressure and to allow for tolerance errors in the manufacturing process.

BRIEF DESCRIPTION OF THE DRAWINGS

The quick change coupling of the present invention may be better understood by one of ordinary skill in the art through a reading of the following detailed description of the preferred embodiment of the invention, taken in conjunction with the accompanying drawings, wherein:

FIGS. 3A and 3B comprise a view similar to FIGS. 1A and 1B, but with the coupling completely engaged.

DETAILED DESCRIPTION OF THE PREFERRED EMBODIMENT

Figure 1A:
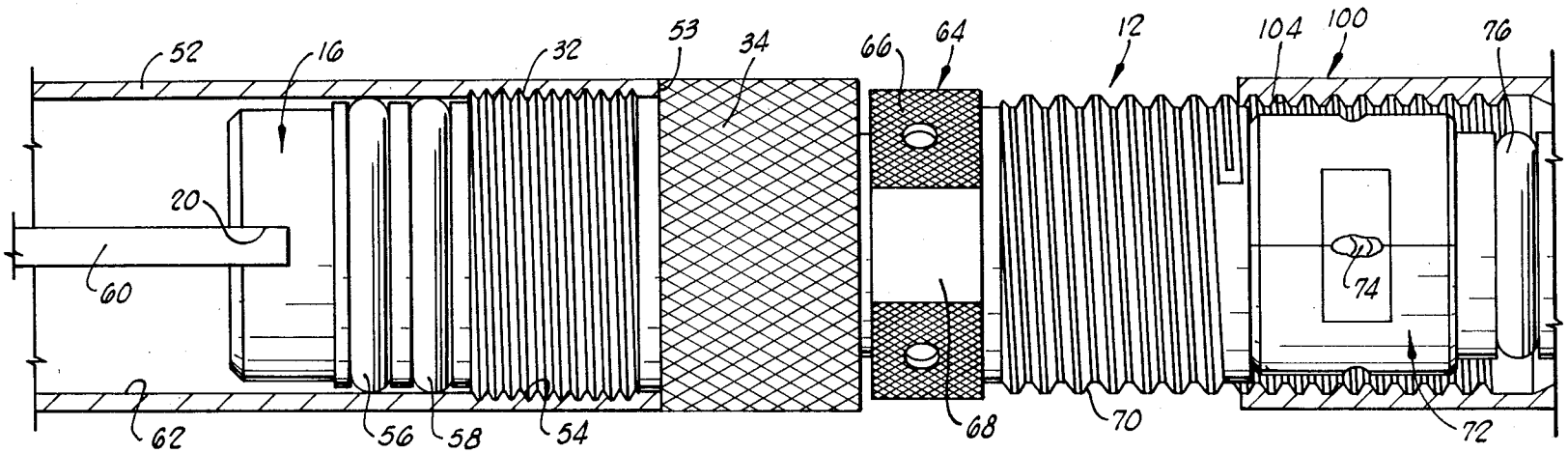
FIGS. 1A and 1B comprise a sectional elevation of the preferred embodiment of the coupling of the present invention prior to being made up.

Referring to FIGS. 1A, 1B, 4, 5, 6 and 6A, quick change coupling 10 comprises a male component 12 and a female component 14.

Male component 12 includes tubular housing 16 (see FIG. 5 for section) having an axial bore 18 running therethrough, the left end thereof (looking at FIG. 5) having a plurality of diametrically opposed slots 20, one being shown, cut therein. The right end of bore 18 flares outwardly at 22, to connector body chamber 24, which opens on the right end of housing 16. The bottom of housing 16 at chamber 24 includes longitudinal slot 26 extending through the wall thereof.

The exterior of housing 16 includes O-ring grooves 28 and 30, threads 32, annular shoulder 34, cylindrical coupling bolt seat 36, reduced diameter cylindrical retainer lock seat 38, and cylindrical guide nose 40 having O-ring grooves 42 and 44 therein. Coupling surface is terminated by chamfer 46. Roll pin aperture 48 and alignment port 50 extend from connector body chamber 24 to coupling seal surface 40.

Referring again to FIGS. 1A and 1B, housing 16 is shown threaded to threads 54 of tubular logging tool housing 52, O-rings 56 and 58 disposed in grooves 28 and 30 (filled by O-rings) creating a pressure-tight seal with inner wall 62 of housing 52. Edge 53 of housing 52 abuts annular shoulder 34 of housing 16. Strip type circuit board carrier 60 is shown disposed in slots 20, and is secured to housing 16 by set screws (not shown) protruding through the wall of housing 16.

Figure 4:
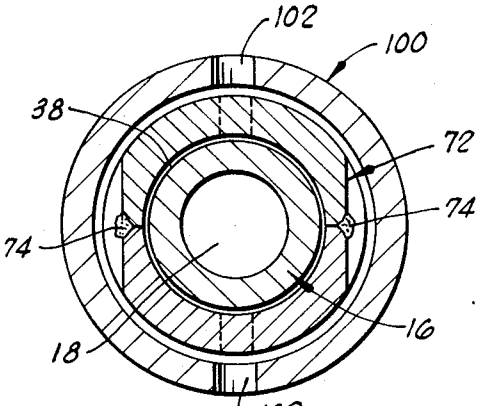
FIG. 4 is a cross-section taken across line 4—4 of FIG. 3A.
Figure 5:
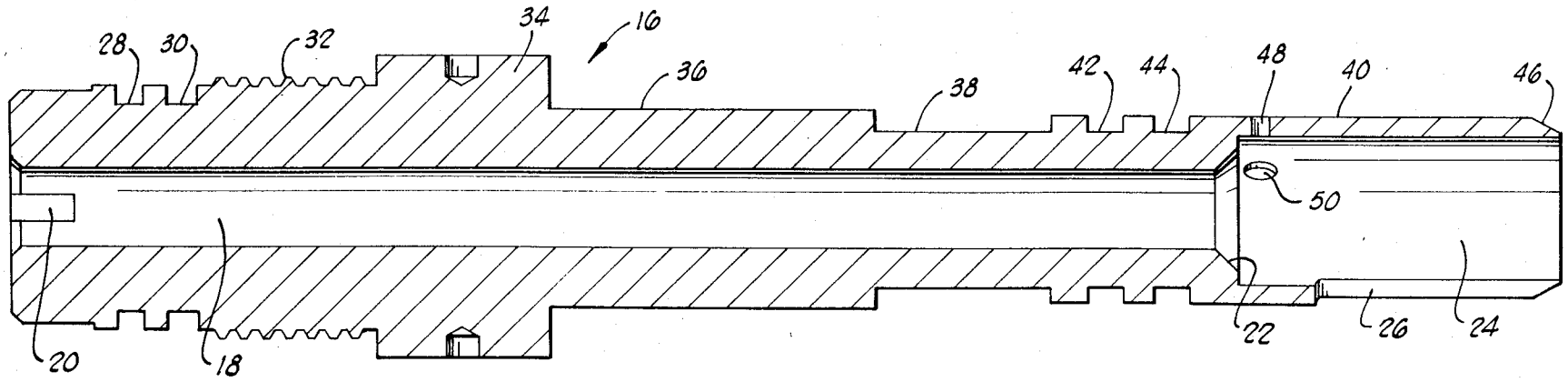
Figure 6:
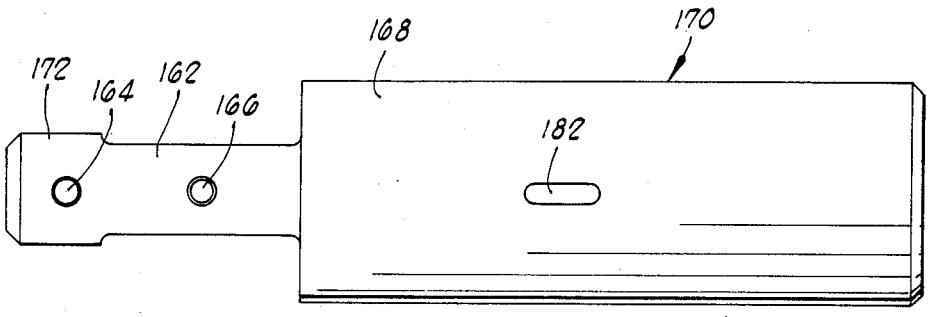
FIG. 6 is a top elevation of the location coupling stabilizer employed in the female component of the coupling.
Figure 6A:
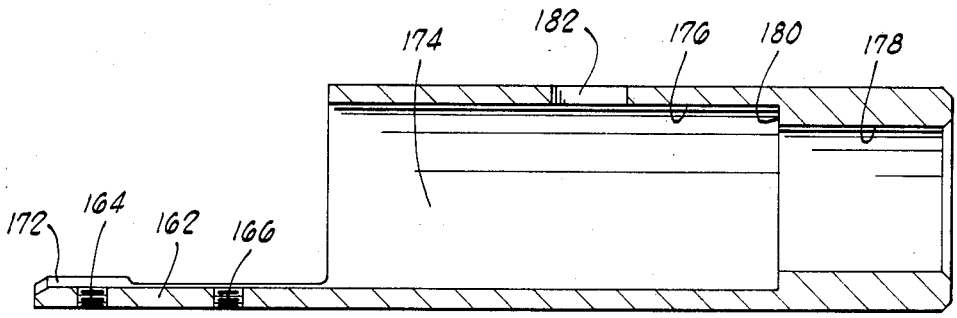
FIG. 6A is a side full section elevation of the location coupling stabilizer.

Coupling bolt 64 including alternate knurled gripping surfaces 66 and wrench flats 68 as well as exterior threads 70 to the right thereof, is mounted on seat 36 of housing 16 in free rotational relationship with respect thereto, and is maintained thereon by retainer lock 72, which is placed over lock seat 38 of housing 16 in two pieces and tack welded together at diametrically opposite locations 74, as shown in FIG. 4. O-rings 76 and 78 are disposed in grooves 42 and 44 of housing 16.

Connector chamber 24 contains coupling sleeve 80 therein, which is maintained in housing 16 via roll pin 82 extending through aperture 48. Like housing 16, sleeve 80 has an alignment port 84 extending therethrough, in order to facilitate alignment of the two parts for insertion of roll pin 82. Sleeve lock 86 extends between sleeve 80 and the inner wall of connector body chamber 24, and is secured to sleeve 80 by roll pin 88. Socket connector body 90, which may comprise by way of example and not limitation, a Bendix size 17–99 female insert for Tri-Start Connector is maintained in connector body chamber 24 between sleeve 80 and sleeve lock 86.

Female coupling component 14 includes tubular coupling sleeve 100 having a relatively uniform outer surface pierced by relief ports 102, which extend to the interior. The left end of coupling sleeve 100, as seen in FIG. 1A on the right, carries internal threads 104 adapted to mate with threads 70 on coupling bolt 64 to the right of internal threads 104 is smooth inner wall 106, pierced by pressure relief ports 102, which terminates at inwardly extending radial shoulder 108. To the right of shoulder 108, coupling seal surface 110 extends to a second radial shoulder 112, which extends outwardly to internal threads 114, which lead to coupling body seal surface 116, terminating at edge 118.

Threads 114 are made up with threads 122 on the exterior of coupling body 120, until edge 118 on coupling sleeve 100 abuts radial exterior shoulder 124 on coupling body 120. The exterior 126 of body 120 is of substantially the same diameter as sleeve 100, and is defined between the aforementioned shoulder 124 and a second radial shoulder 128, adjacent to which threads 130 extend toward O-ring grooves 132 and 134. Tool housing 140, which may carry instruments or other devices (not shown) to be electrically connected through coupling 10 to circuit board or boards (not shown) on circuit board carrier 60 in tool housing 52, carries threads 142 on its interior which mate with threads 130 on coupling body 120. The inside wall 144 of tool housing 140 provides a sealing surface against which O-rings 146 and 148, disposed in grooves 132 and 134 bear when coupling body 120 is made up with tool housing 140, edge 141 abutting radial shoulder 128.

Figure 1B:
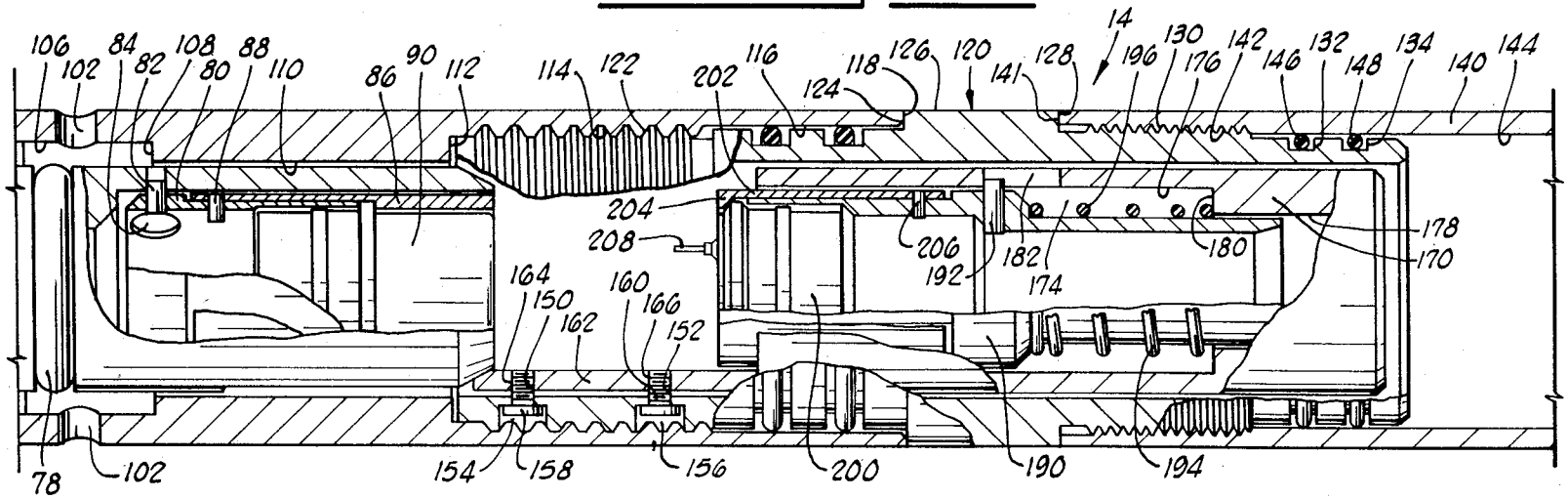

Referring to the lower side of coupling body 120 as depicted in FIG. 1B, anchor pin apertures 150 and 152 having countersunk recesses 154 and 156 extend through the wall of coupling body 120. Threaded anchor pins 158 and 160 extend through apertures 150 and 152 and engage threaded apertures 164 and 166 in key 162 which extends longitudinally from the major portion 168 of coupling location stabilizer 170, shown in FIGS. 6 and 6A. As may be seen in FIGS. 6 and 6A, stabilizer 170 is essentially tubular in shape, with key 162 extending longitudinally from a portion of the wall thereof. At the end of key 162, tab 172 protrudes slightly in laterally circumferential directions. The interior of the major portion 168 of stabilizer 170 comprises a stepped chamber 174 defined by inner walls 176 and 178, connected by radial annular wall 180. Pin guide slot 182 extends through the wall of major portion 168 into chamber 174.

Pin coupling sleeve 190 is slidably disposed within stabilizer 170. Guide pin 192, which extends from the wall of sleeve 190 into guide slot 182 of stabilizer 170, maintains rotational alignment of the two components. Coil spring 194, which bears against shoulder 196 on sleeve 190 and radial wall 180 on stabilizer 170, biases sleeve 190 to the left. Pin connector body 200, which may be a Bendix size 17-99 male insert for Tri-Start Connector, is disposed within sleeve 190, and is maintained therein by sleeve lock 202, having annular lip 204 extending radially inward thereon. Sleeve lock 202 is secured to coupling sleeve 190 by roll pins 206 (one shown). A plurality of connector pins 208 (one shown for example and not by way of limitation) protrude longitudinally to the left toward socket connector body 90.

It will be understood, of course, that electrical conductors (not shown) extend between circuit boards (not shown) mounted on circuit board carrier 60 and socket connector body 90, and between pin connector body 200 and instruments or other devices (not shown) within tool case 140. These items have been omitted for purposes of clarity and because connector bodies 90 and 200 and the electrical connectors, instruments or other devices which may be employed therewith are well known in the art and do not form part of the invention claimed herein.

OPERATION OF THE PREFERRED EMBODIMENT

Referring to FIGS. 1-3 and 5 of the drawings, the operation of quick change coupling 10 will be hereafter described.

In FIGS. 1A and 1B, male component 12 is shown partially inserted into tubular coupling sleeve 100 of female component 14. Guide nose 40 of housing 16 is disposed adjacent coupling seal surface 110 inside sleeve 100. Slot 26 in housing 16 (not shown) has just begun to engage tab 172 of key 162 protruding from stabilizer 170. Connector pins 208 have not engaged socket connector body 90.

Figure 2A:
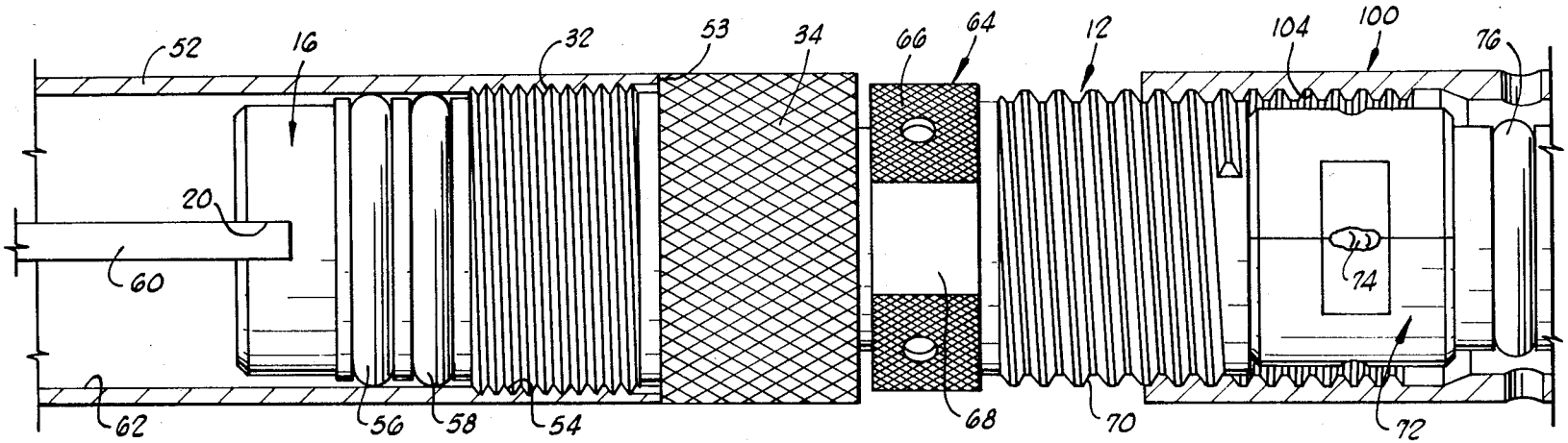
FIGS. 2A and 2B comprise a view similar to FIGS. 1A and 1B, but with the coupling partially engaged.
Figure 2B:
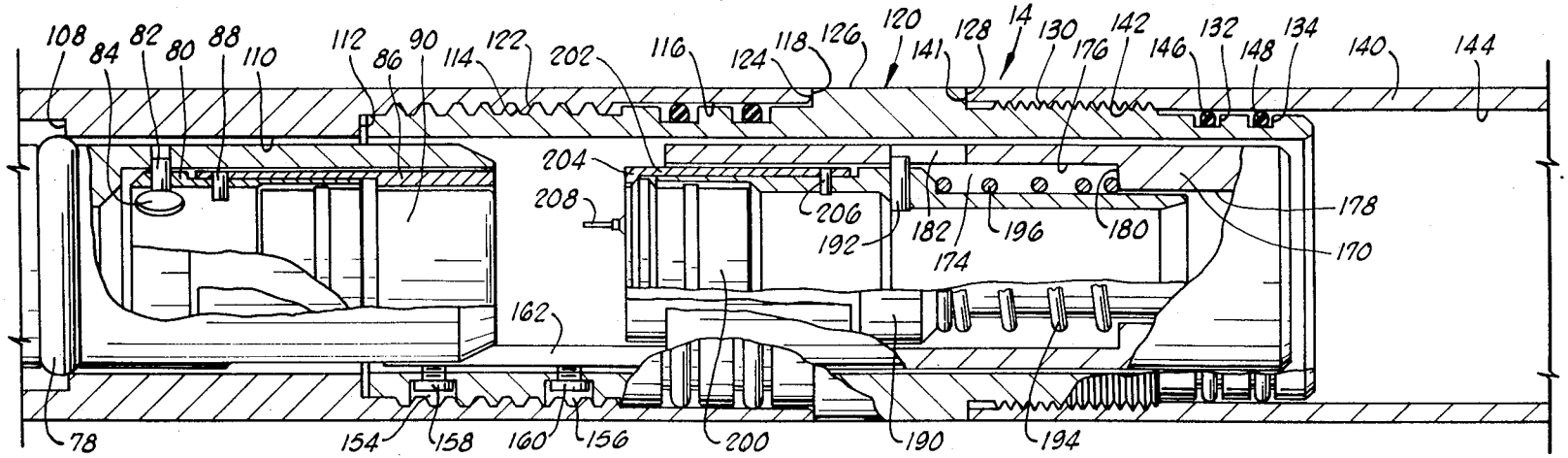
Figure 5A:
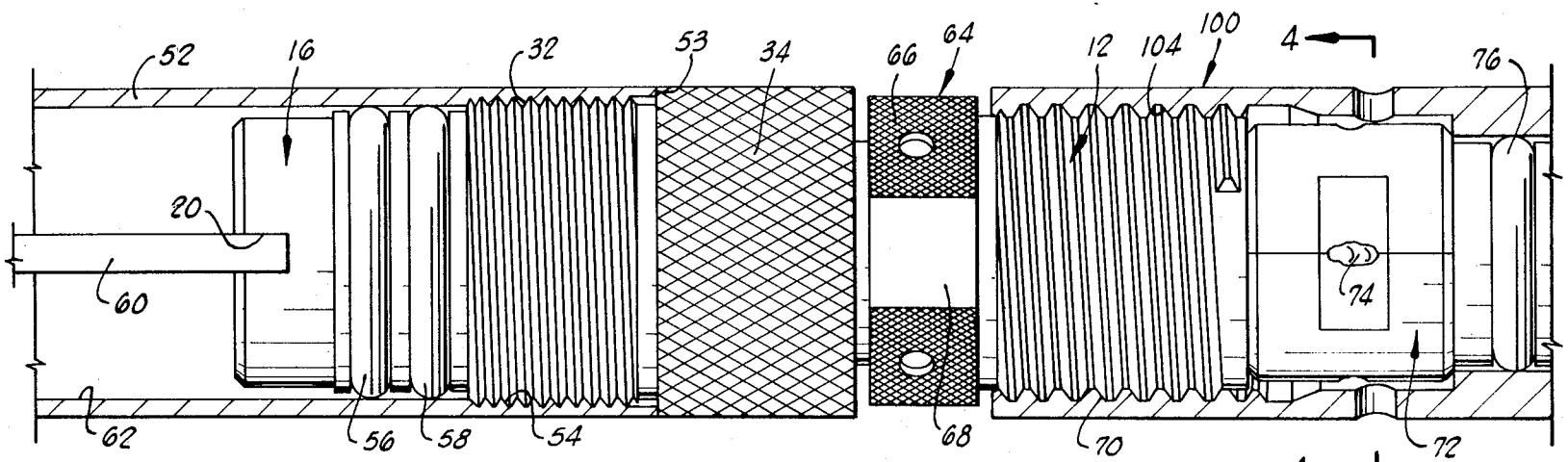
FIG. 5 is a full sectional view of the housing of the male coupling portion.
Figure 5B:
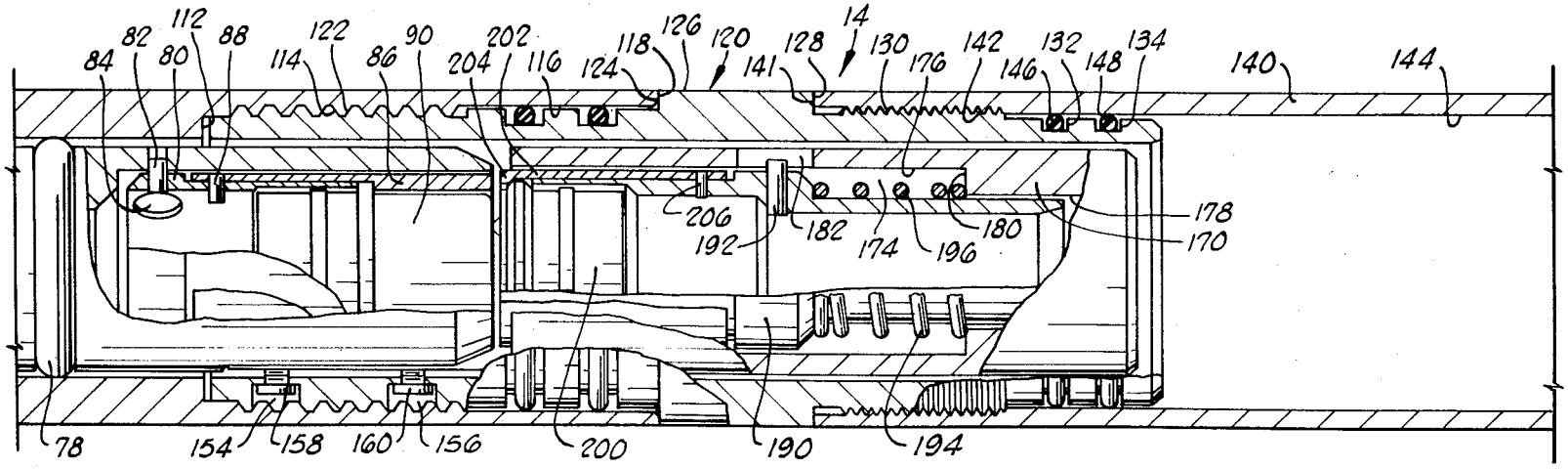

In FIGS. 2A and 2B, slot 26 in housing 16 has securely engaged key 162 of stabilizer 170, preventing relative rotation between housing 16 and stabilizer 170. Guide nose 40 of housing 16 has entered coupling body 120, but socket connector body 90 is still out of contact with connector pins 208. However, proper alignment of pins 208 with their respective sockets in socket connector body 90 is assured by key 112 and slot 26. External threads 70 on coupling bolt 64 have engaged internal threads 104 on sleeve 100, and bolt 64 has been rotated to partially mate up threads 70 with threads 104. As a result, O-ring 78 on guide nose 40 of housing 16 has contacted the leading edge of coupling seal surface 110 at radial shoulder 108.

In FIGS. 3A and 3B, threads 70 of coupling bolt 64 have been fully made up with threads 104 in coupling sleeve 100, and housing 16 has thereby been drawn into sleeve 100, whereat O-rings 76 and 78 on guide nose 40 sealingly abut coupling seal surface 110. Socket connector body 90 has been disposed against pin connector body 200 in alignment therewith, connector pins 208 being received in their associated sockets (not shown) in socket connector body 90. Continued threading of connector bolt 64 to sleeve 100 after initial engagement of socket connector body 90 with pin connector body 200 results in the movement of pin coupling sleeve 190 to the right (as seen in comparing FIGS. 1B and 3B) against the bias of coil spring 194, which acts between shoulder 196 on pin coupling sleeve 190 and radial wall 180 on stabilizer 170. Rotational movement of pin connector body 200 with respect to stabilizer 170, and therefore housing 16, is prevented by upstanding guide pin 192, which is rotationally constrained by pin guide slot 182 in stabilizer 170. Of course, the longitudinal extent of pin guide slot 182 allows sufficient movement of pin connector body 200 to the right so as to avoid damage to connector bodies 90 and 20, as well as other components.

Therefore, as shown fully made up in FIGS. 3A and 3B, quick change coupling 10 provides a fluid and pressure tight seal with O-rings 76 and 78 sealingly engaging seal surface 110. The respective male and female components 12 and 14 of coupling 10 may be readily and easily disengaged from each other, and reengaged again or made up with other mating coupling components associated with other logging tool housings containing different instruments or other devices. Moreover, proper alignment of the electrical connections for instruments or other devices in adjacent tool housings is assured by the constraint of key 162 in slot 26 while the constrained engagement of such connections is assured by the biasing action of spring 194.

While the quick change coupling of the present invention has been described as having utility as a coupling for logging tools, the invention is not so limited, having equal utility wherever a reliable, easy to use sealed coupling for electrical connections is desired. Moreover, while the present invention has been disclosed in terms of a preferred embodiment, many additions, deletions and modifications may be made thereto without departing from the spirit and scope of the claimed invention. For example, the positions of the pin and socket connector bodies may be reversed; the sealing O-rings between sleeve 100 and guide nose 40 may be carried on interior grooves in coupling seal surface 110 and act against the exterior of a guide nose 40 without grooves therein; coupling bolt 64 may carry a lug or lugs thereon which engage a slot or continuous thread inside sleeve 100, or may have a slot thereon engaged by a lug or lugs protruding radially inward from sleeve 100; other types of biasing means such as Belleville springs or a resilient elastomeric sleeve may be employed in lieu of coil spring 194; coupling sleeve 100 and coupling body 120 may be made as a single piece; and others.

I claim:

1. A quick change coupling for a downhole tool, comprising:

male coupling component means;

female coupling component means including coupling body means having coupling sleeve means extending coaxially therefrom, said coupling sleeve means adapted to receive a portion of said male coupling component means therein;

seal means between said male coupling component means and said female coupling component means;

pin body means associated with one of said coupling component means and having a plurality of electrical connector pins extending longitudinally therefrom;

socket body means associated with the other of said coupling component means and having a plurality of electrical connector sockets therein adapted to engage said pins;

alignment means adapted to align said pins with said sockets;

thread means adapted to secure said coupling components together;

body sleeve means disposed within said coupling body means and adapted to hold one of said pin and socket body means;

resilient biasing means associated with at least one of said pin and socket body means and adapted to longitudinally bias said at least one pin or socket body means held by said body sleeve means toward the other of said pin or socket body means and said coupling sleeve means;

substantially tubular stabilizer means fixedly secured inside said coupling body means, said body sleeve means being disposed within said stabilizer means; and guide means adapted to prevent relative rotation between said body sleeve means and said coupling body means, said guide means comprising a longitudinally extending slot in the wall of said stabilizer means and a radially extending pin protruding through said slot from said body sleeve means.

2. The coupling of claim 1, wherein said stabilizer means includes key means, and said male coupling component means includes cooperating slot means, said key means and said slot means together comprising said alignment means.

3. A quick change coupling for a downhole tool, comprising:

male coupling component means;

female coupling component means including coupling body means having coupling sleeve means extending coaxially therefrom, said coupling sleeve means adapted to receive a portion of said male coupling component means therein;

seal means between said male coupling component means and said female coupling component means;

pin body means associated with one of said coupling component means and having a plurality of electrical connector pins extending longitudinally therefrom;

socket body means associated with the other of said coupling component means and having a plurality of electrical connector sockets therein adapted to engage said pins;

resilient biasing means associated with at least one of said pin and socket body means and adapted to bias said at least one pin or socket body means toward the other of said pin or socket body means;

alignment means adapted to align said pins with said sockets; and thread means adapted to secure said coupling components together, said thread means comprising a female thread on the interior of said coupling sleeve means and a mating male thread on coupling bolt means disposed on said male coupling component means and adapted to freely rotate with respect thereto, said coupling bolt means being maintained on said male coupling component means between a longitudinally spaced exterior radially extending shoulder thereon and a retainer lock means.

4. The coupling of claim 3, wherein said seal means comprises at least one O-ring associated with one of said coupling component means, and a cooperating seal surface associated with the other of said coupling component means.

5. The coupling of claim 4, wherein said at least one O-ring is carried on said male coupling component means, and said seal surface is disposed on the interior of said coupling sleeve means.

6. The coupling of claim 5, wherein said alignment means comprises cooperating key means and slot means.

7. The coupling of claim 6, wherein said key means protrudes longitudinally inside said coupling body means, and said slot means is disposed in the wall of said male coupling component means.

8. The coupling of claim 7, wherein said key means extends from substantially tubular stabilizer means within which is disposed one of said pin and socket body means, said stabilizer means being fixedly secured to said coupling body means.

9. The coupling of claim 8, further comprising body sleeve means disposed within said coupling body means and adapted to hold one of said pin and socket body means; and guide means adapted to prevent relative rotation between said body sleeve means and said coupling body means;

said resilient biasing means being adapted to longitudinally bias said one of said pin and socket body means held by said body sleeve means toward said coupling sleeve means.

* * * * *